US006550518B1

(12) United States Patent
Lee

(10) Patent No.: US 6,550,518 B1
(45) Date of Patent: Apr. 22, 2003

(54) FILM-TAPE ERASER WITH RETRACTABLE DISPENSING HEAD

(75) Inventor: James Lee, Taipei (TW)

(73) Assignee: Chong-Z International Co., Taipei (TW)

( * ) Notice: Subject to any disclaimer, the term of this patent is extended or adjusted under 35 U.S.C. 154(b) by 0 days.

(21) Appl. No.: 10/020,155

(22) Filed: Dec. 18, 2001

(51) Int. Cl.[7] ..... B32B 31/00

(52) U.S. Cl. ..... 156/577; 156/523; 156/579; 118/76; 242/160.4; 242/171; 242/588.6

(58) Field of Search ..... 156/238, 523, 156/527, 540, 574, 577, 579; 225/46; 242/160.2, 160.4, 170, 171, 588, 588.2, 588.3, 588.6; 118/76, 200, 257

(56) References Cited

U.S. PATENT DOCUMENTS 5,679,156 A * 10/1997 Matsumaru ..... 118/200

6,321,815 B1 * 11/2001 You ..... 156/577

* cited by examiner

*Primary Examiner*—Mark A. Osele
(74) *Attorney, Agent, or Firm*—Rabin & Berdo, P.C.

(57) ABSTRACT

A film-tape eraser with retractable dispensing head mainly includes a case, a dispensing mechanism, and a movable strip. The dispensing mechanism is forward and backward movably fitted in the case and includes a dispensing head normally projected from a dispensing opening at a lower front of the case for dispensing an erasing film-tape. The movable strip is set in a guide way provided below a curved top of the case with a rear end of the movable strip engaged with a rear end of the dispensing mechanism. When the movable strip is moved forward, it pulls the dispensing mechanism backward to retract the dispensing head into the case and closes the dispensing opening with a front section thereof; and when the movable strip is moved backward, the dispensing opening is opened and the dispensing mechanism is pushed forward to project the dispensing head from the dispensing opening.

4 Claims, 7 Drawing Sheets

FILM-TAPE ERASER WITH RETRACTABLE DISPENSING HEAD

BACKGROUND OF THE INVENTION

1. Field of the Invention

The present invention relates to a film-tape eraser, and more particularly to a film-tape eraser with retractable dispensing head.

2. Description of the Prior Art

Most of the commercially available film-tape erasers do not include a cap, and are therefore subject to a damaged or deformed dispensing head when the erasers are unexpectedly dropped or impacted. A damaged or deformed dispensing head fails to dispense an erasing film-tape smoothly and continuously, resulted in an incomplete erasing.

Even if a film-tape eraser initially includes a cap to protect the dispensing head against undesired damage or deformation, the cap tends to be ignored or discarded soon because it causes inconveniences to a user who has to remove and replace the cap each time the eraser is used.

It is therefore tried by the inventor to develop a film-tape eraser having a movable strip associated with a case of the eraser, so that a user may conveniently control the movable strip to retract or extend the dispensing head into or out of the case of the film-tape eraser.

SUMMARY OF THE INVENTION

A primary object of the present invention is to provide a film-tape eraser with retractable dispensing head to easily protect the eraser from a damaged or deformed dispensing head due to any unexpected dropping of or impacting against the eraser.

To achiever the above and other objects, the film-tape eraser with retractable dispensing head according to the present invention mainly includes a case, a dispensing mechanism, a movable strip, and a bottom cover. The dispensing mechanism is forward and backward movably fitted in the case and includes a dispensing head normally projected from a dispensing opening at a lower front of the case for dispensing an erasing film-tape. The movable strip is set in a guide way provided below a curved top of the case with a rear end of the movable strip engaged with a rear end of the dispensing mechanism. The bottom cover is pivotally connected at an end to a bottom of the case to open or close the case. When the movable strip is moved forward, it pulls the dispensing mechanism backward to retract the dispensing head into the case and closes the dispensing opening with a front section thereof; and when the movable strip is moved backward, the dispensing opening is opened and the dispensing mechanism is pushed forward to project the dispensing head from the dispensing opening.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
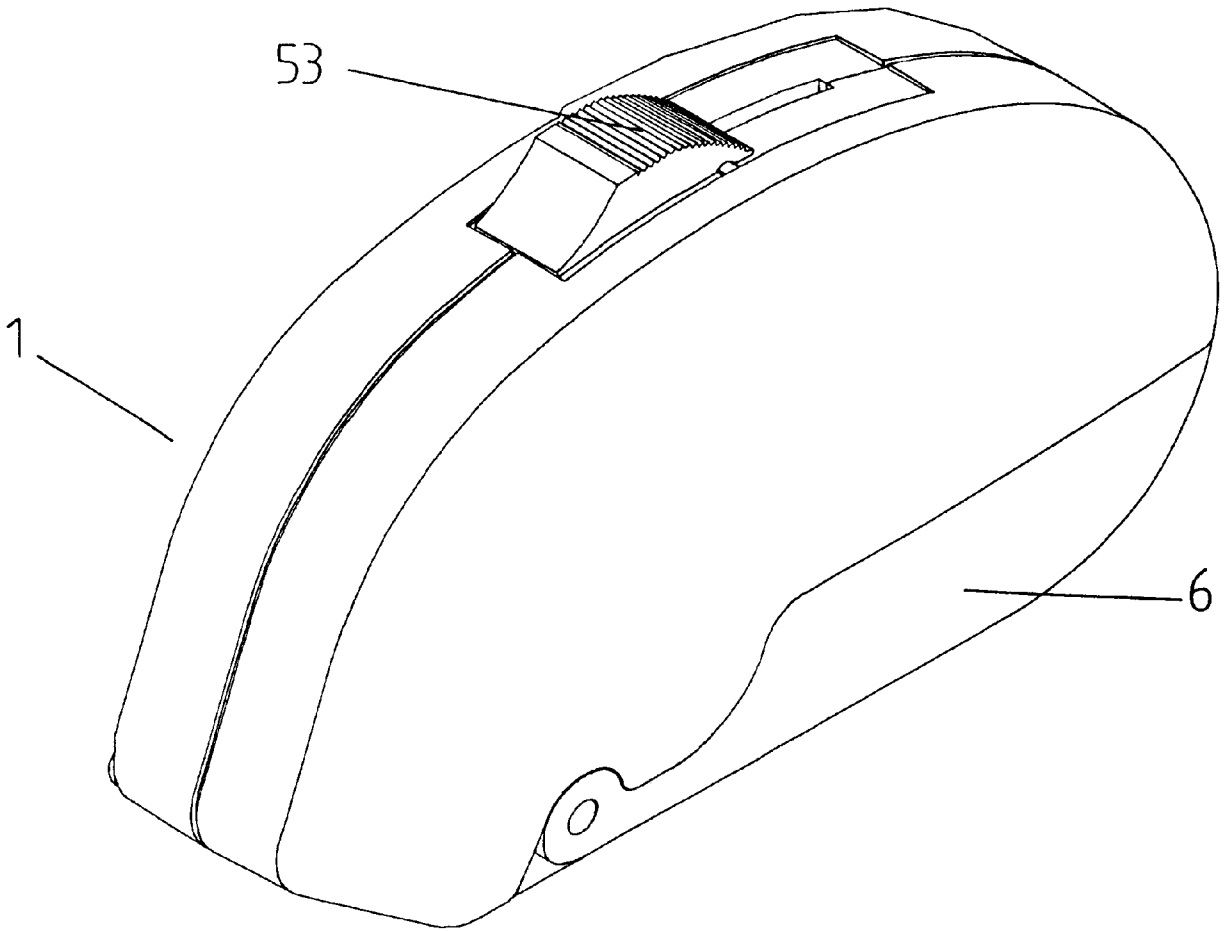
FIG. 1 is an assembled front perspective view of a film-tape eraser with retractable dispensing head according to a preferred embodiment of the present invention, wherein a push block thereof is in a forward pushed position.
Figure 2:
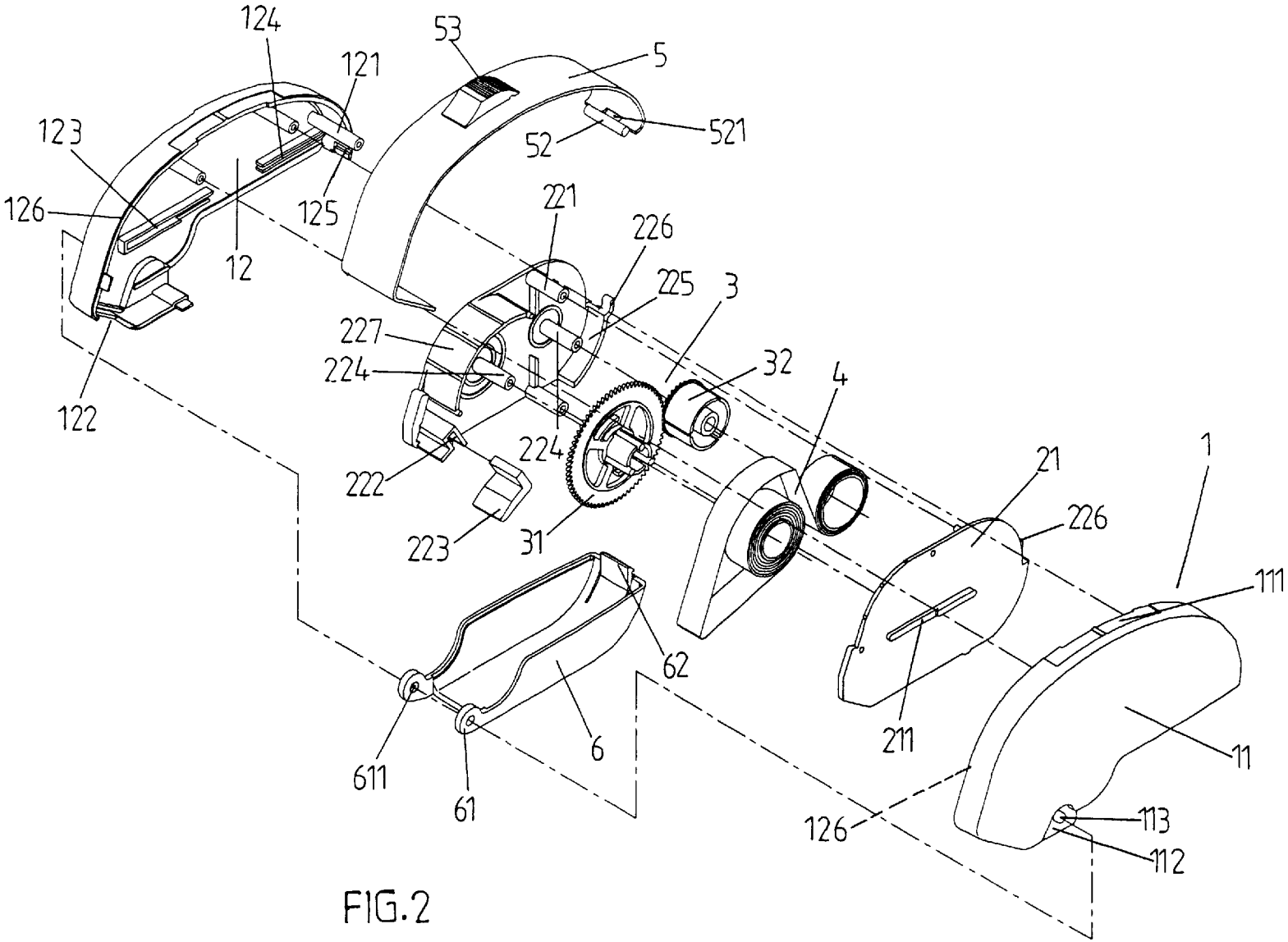
FIG. 2 is an exploded perspective view of FIG. 1.

Please refer to FIGS. 1 and 2 that are assembled and exploded front perspective views, respectively, of a film-tape eraser with retractable dispensing head according to a preferred embodiment of the present invention. As shown, the film-tape eraser mainly includes a case 1, a dispensing mechanism 2, a transmission mechanism 3, an erasing film-tape 4, a movable strip 5, and a bottom cover 6.

The case 1 includes a first half 11 and a second half 12 that are assembled into a complete case 1 having an outward curved top. The second half 12 of the case 1 is provided at an inner side with three inward projected connecting shafts 121 for engaging with connecting means correspondingly provided at an inner side of the first half 11 of the case 1. A dispensing opening 122 is formed at a lower front of the case 1 after the first and the second half 11, 12 are assembled to each other. A pair of pivoting supports 112 having two pivot shafts 113 is provided on the case 1 slightly behind two lateral sides of the dispensing opening 122, and a locking means 125 is provided at a rear end of the case 1. The first and the second half 11, 12 of the case 1 are provided at their respective inner sides near a front middle and a rear middle portion with a slide way 123 and an orienting channel 124, respectively. The slide way and the orienting channel provided at the inner side of the first half 11 is not shown in FIG. 2. A guide way 126 is formed below the curved top of the case 1 for receiving the movable strip 5 therein. A longitudinally extended curved recess 111 is formed near a central portion of the curved top of the case 1 after the first and the second half 11, 12 are assembled to each other. A narrow slit 111*a* is formed along a centerline of the curved recess 111, and a top rib 111*b* is formed to extend across a top of the curved recess 111 at a predetermined position.

Figure 3:
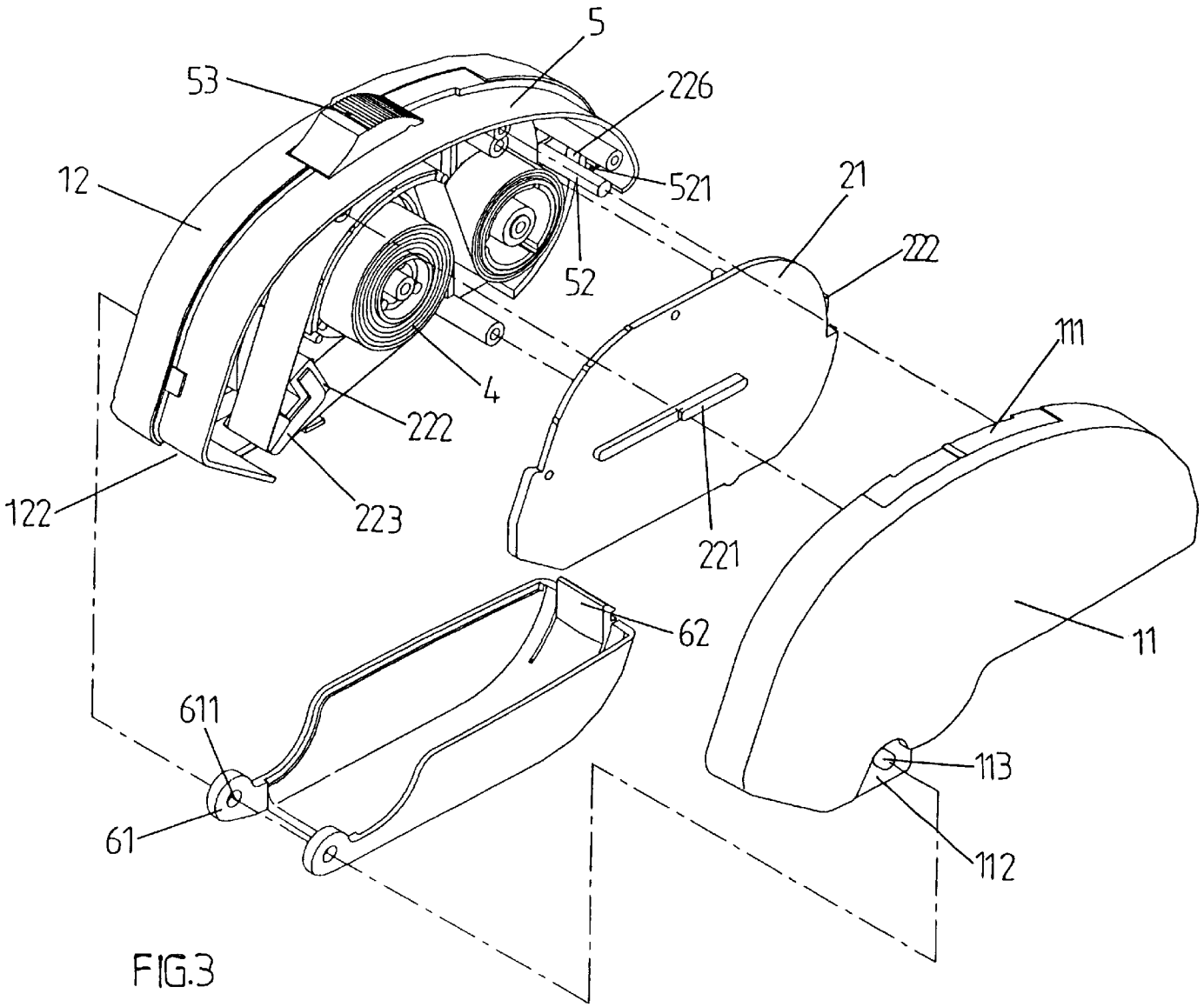
FIG. 3 is a partially assembled perspective view of FIG. 2.

Please refer to FIGS. 2 and 3 at the same time. The dispensing mechanism 2 is used to dispense the erasing film-tape 4 and has a profile very close to that of the curve-topped case 1 for fitly mounting in the case 1. The dispensing mechanism 2 mainly includes a side cover 21 and a base 22. The base 22 is provided at an inner side with a plurality of inward projected mounting shafts 221 for engaging with connecting means (not shown) correspondingly provided at an inner side of the side cover 21. The base 22 is also provided near front middle and rear middle portions of its inner side with two inward projected fixing shafts 224. A guide strip 227 is connected at a longitudinal edge to an upper front of the base 22, and a curved strip 225 is connected at a longitudinal edge to a lower rear end of the base 22, such that both the guide strip 227 and the curved strip 225 are inward projected from the inner side of the base 22. A first curved lug 226 extends from an upper outer corner of the curved strip 225 by a predetermined distance. And, a mounting channel 222 is provided at a lower front of the base 22 for a dispensing head 223 to insert therein.

The transmission mechanism 3 includes a driving tape reel 31 and a driven tape reel 32 being separately mounted on the two fixing shafts 224. The erasing film-tape 4 is wound about the driving tape reel 31 and the driven tape reel 32 in a predetermined manner, such that the erasing film-tape 4 passes a front end of the dispensing head 223. After the erasing film-tape 4 is mounted on the transmission mechanism 3, which has been mounted on fixing shafts 224 of the dispensing mechanism 2, the side cover 21 is assembled onto the inner side of the base 22 to complete the dispensing mechanism 2.

The side cover 21 of the dispensing mechanism 2 is provided at a rear end with a second curved lug 226, which is located at one side of the first curved lug 226 on the base 22 and forms a symmetrical mate of the first curved lug 226 after the side cover 21 is fixed to the inner side of the base 22. The side cover 21 and the base 22 forming the dispensing mechanism 2 are provided at their respective outer sides near a central portion thereof with a longitudinally extended rib 211. When the dispensing mechanism 2 is mounted in the case 1, the two ribs 211 are correspondingly received in the slide ways 123 provided at inner sides of the first and the second half 11, 12, so that the dispensing mechanism 2 is locally slidable forward and backward in the case 1 along the slide ways 123.

Figure 5:
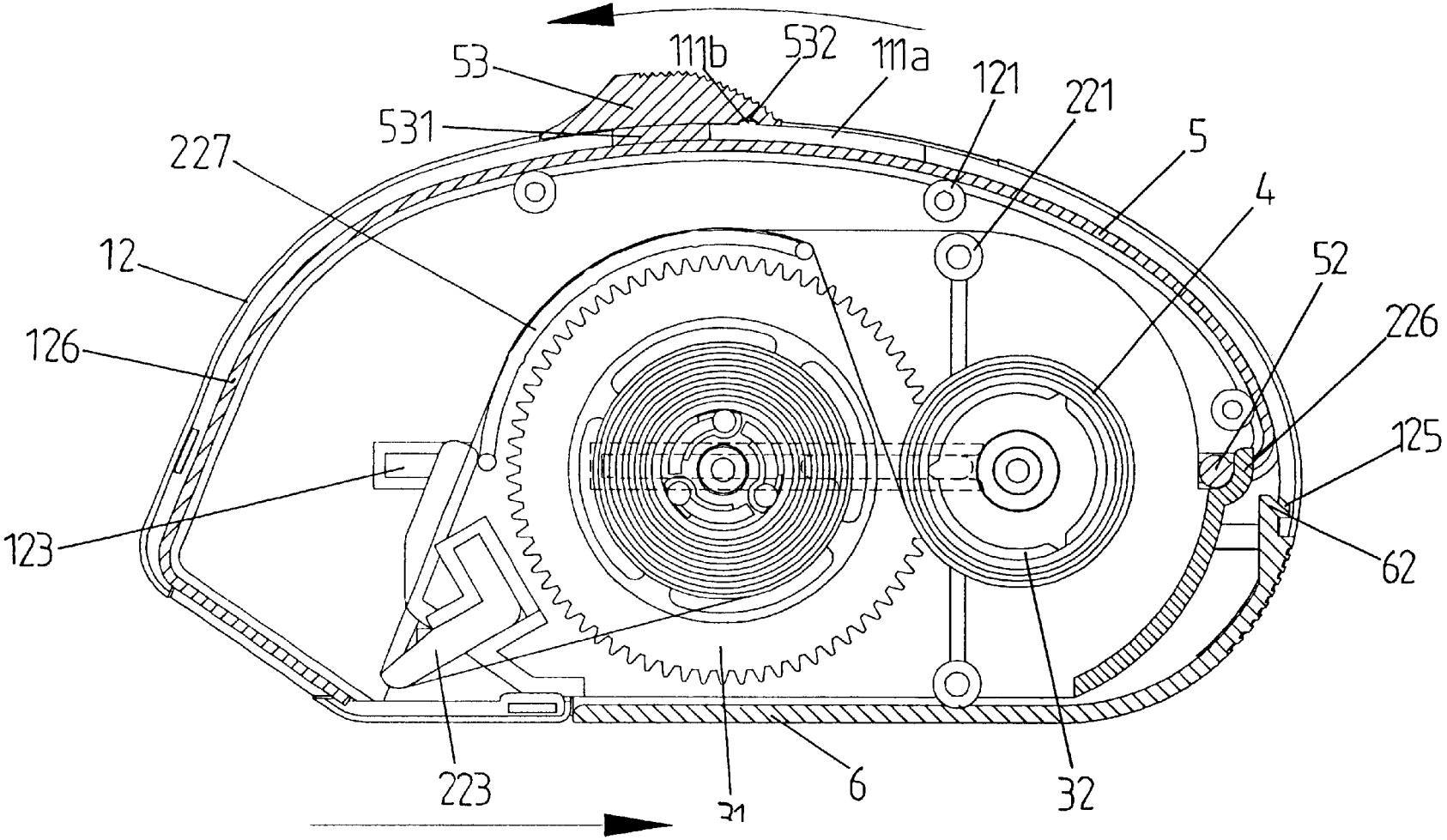
FIG. 5 is a sectioned side view of the film-tape eraser of FIG. 1 with the push block thereof in the forward pushed position.

The movable strip 5 is a flat strip made of a flexible material. Please refer to FIGS. 2, 3, and 5 at the same time. A push block 53 is connected to a top of the movable strip 5 via a guide rib 531. The push block 53 is provided at a bottom with a transverse groove 532, and at a part of a top surface with a plurality of antislip lines.

A crossbar 52 is connected to a rear end of the movable strip 5, and a through hole 521 is formed on the movable strip 5 at a joint of the movable strip 5 and the crossbar 52.

Figure 4:
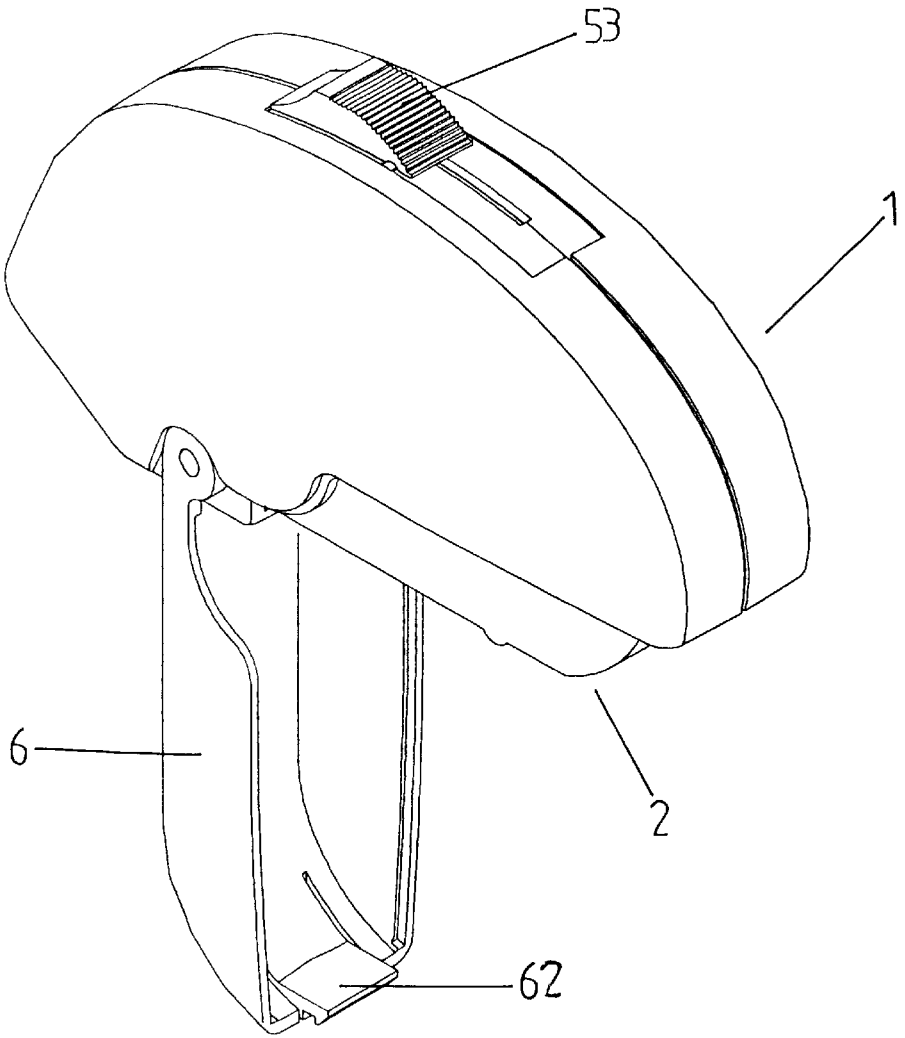
FIG. 4 is an assembled rear perspective view of the present invention with a bottom cover thereof in an opened position.

Please refer to FIG. 4. The bottom cover 6 is provided at a front end with a pair of lugs 61, each of which has a pivoting hole 611 for pivotally engaging with the pair of pivot shafts 113 provided at the lower front of the case 1, so that the bottom cover 6 is turnable about the pivot shafts 113 to an opened position or a closed position relative to the case 1. When the bottom cover 6 is in the closed position, a locking plate 62 elastically connected to a rear end of the bottom cover 6 engages with the locking means 125 on the case 1. To open the bottom cover 6, simply slightly push a tail portion of the locking plate 62 to disengage the locking plate 62 from the locking means 125.

Please refer back to FIG. 5. The present invention is characterized in that the movable strip 5 is received in the guide way 126 formed below the curved top of the case 1, and that a rear section of the movable strip 5 is set in the orienting channels 124 formed at inner sides of the first and the second half 11, 12 of the case 1. The guide rib 531 is located in the top central slit 111*a* of the case 1, allowing the push block 53 connected thereto to expose from the curved recess 111 with a bottom of the push block 53 in contact with the top of the curved recess 111. The crossbar 52 connected to the rear end of the movable strip 5 is abutted against an inner side of the first and the second curved lugs 226 when the latter are upward inserted into the through hole 521. When the push block 53 is pushed forward, the dispensing mechanism 2 connected to the movable strip 5 at the crossbar 52 is longitudinally pulled backward by the forward moved strip 5, as indicated by the arrows in FIG. 5, and the dispensing head 223 of the dispensing mechanism 2 retracts to locate in the case 1 behind the dispensing opening 122. At this point, the transverse groove 532 at the bottom of the push block 53 engages with the top rib 111*b* in the top recess 111 to locate in place, and a front section of the movable strip 5 closes the dispensing opening 122.

Figure 6:
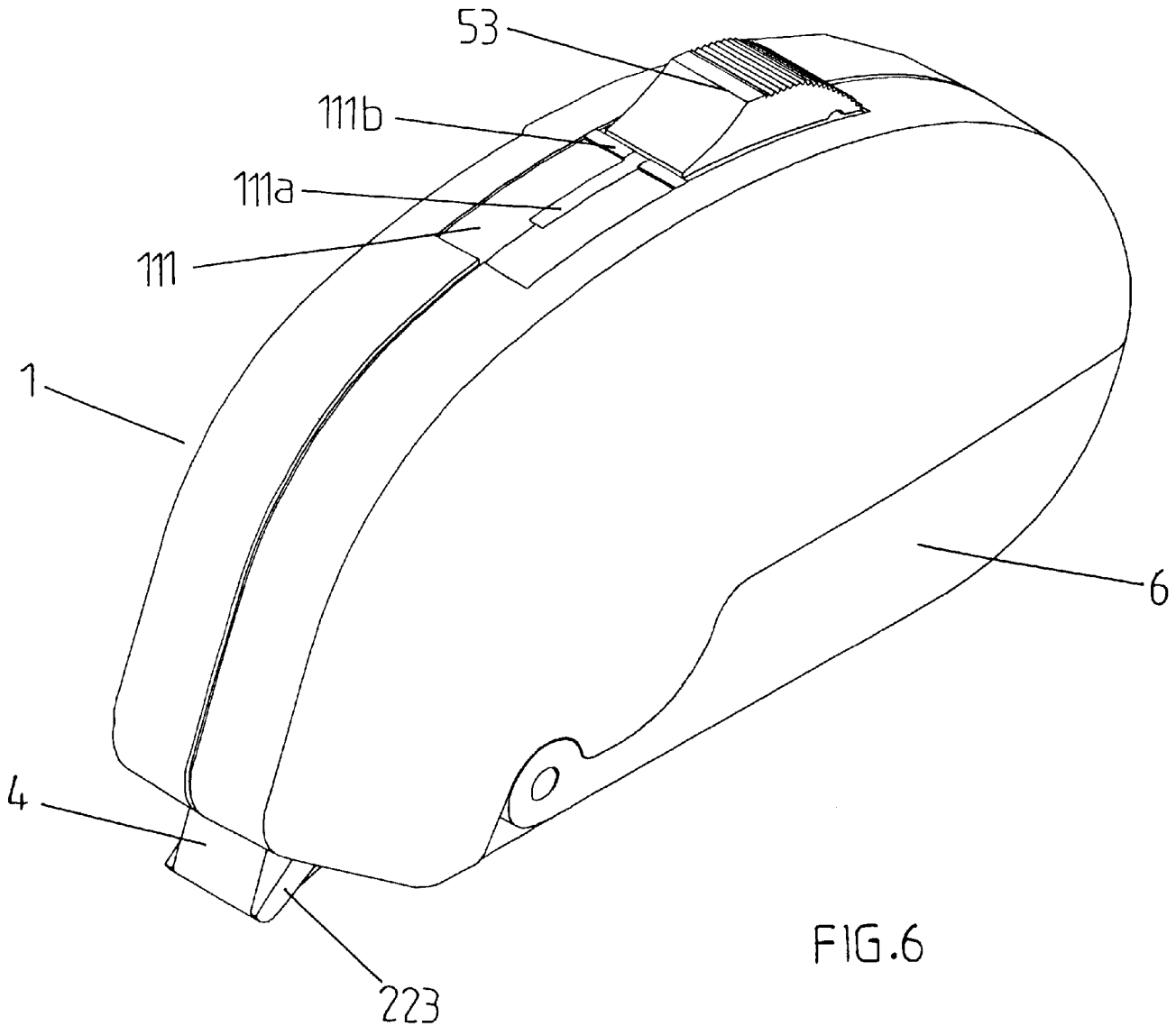
FIG. 6 is an assembled front perspective view of the present invention with the push block thereof in a backward pulled position.
Figure 7:
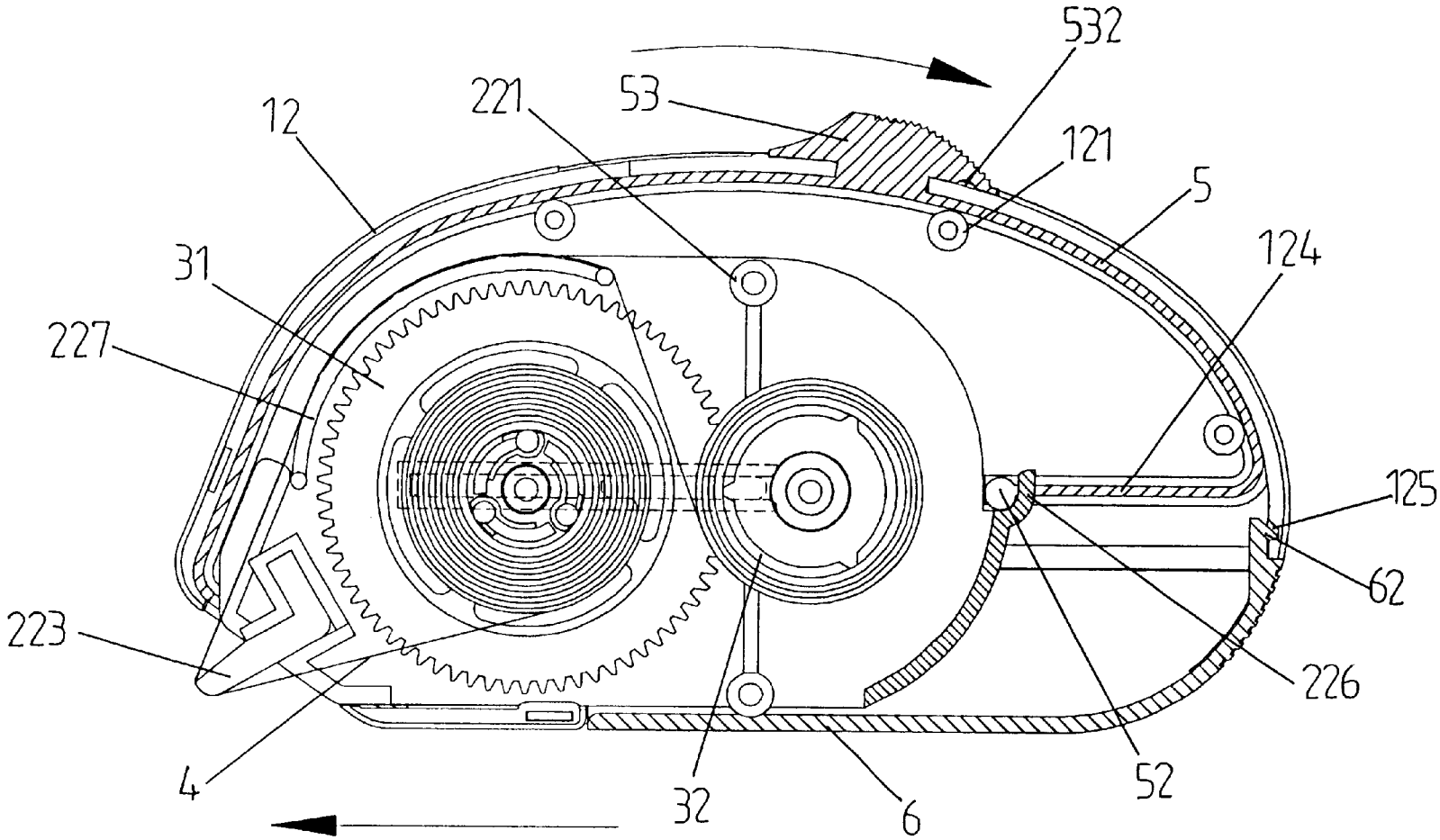
FIG. 7 is a sectioned side view of the film-tape eraser of FIG. 6 with the push block thereof in the backward pulled position.

Please refer to FIGS. 6 and 7. Since the rear section of the movable strip 5 is set in the orienting channels 124 and guided by the latter to move in a predetermined track, a backward pulling force applied on the push block 53 would transfer from the push block 53 to the flexible movable strip 5 and be concentrated at the crossbar 52 to generate a sufficient push at the crossbar 52 against the dispensing mechanism 2, causing the latter to longitudinally move forward. At this point, the front section of the movable strip 5 is moved backward from the dispensing opening 122 to open the latter, and the dispensing head 223 is moved forward to project from the opened dispensing opening 122 for use.

With the above arrangements, a user needs only to push or pull the slide block 53 with a finger to close or open the dispensing opening 122 and retract or extend the dispensing head 223, respectively. The user need not to cover the dispensing head with a cap when the film-tape eraser is not in use, or remove the cap from the dispensing head before using the film-tape eraser. The film-tape eraser of the present invention with the dispensing head in a retracted position is not subject to a damaged or deformed dispensing head even if the eraser is unexpectedly dropped or subjected to an impact. The film-tape eraser with retractable dispensing head according to the present invention completely eliminates drawbacks existing in the conventional film-tape erasers and is therefore very practical for use.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A film-tape eraser with retractable dispensing head, comprising:

a case having a dispensing opening being provided below a curved top with a guide way for a flexible movable strip to slide forward and backward therein; and said movable strip being provided at a predetermined position with a push block that is upward projected from said curved top of said case; and a dispensing mechanism being fitted in said case for dispensing an erasing film-tape, a rear end of said dispensing mechanism being engaged with a rear end of said movable strip, and a front end of said dispensing mechanism having a dispensing head fixed thereto for guiding and dispensing said erasing film-tape;

whereby when said push block is forward pushed or backward pulled to longitudinally move said movable strip, said dispensing mechanism connected to the rear end of said movable strip is backward pulled or forward pushed, respectively, to retract or project said dispensing head into or from said dispensing opening.

2. The film-tape eraser with retractable dispensing head as claimed in claim 1, wherein said case is assembled from a first curved half and a second curved half, and said dispensing opening being provided at a lower front end of said case; a pair of pivoting supports having two pivot shafts being provided on said case slightly behind two lateral sides of said dispensing opening for a bottom cover to pivotally connect thereto, and a locking means being provided at a rear end of said case; said first and the second half of said case being provided at their respective inner sides near a front middle and a rear middle portion with a slide way and an orienting channel, respectively; said guide way being extended along an inner side of the curved top of said case for said movable strip to set therein with a rear section of said movable strip set in said orienting channels; a crossbar being connected to the rear end of said movable strip for pushing or pulling said dispensing mechanism; a longitudinally extended curved recess being formed near a central portion of said curved top of said case, a narrow slit being formed along a centerline of said curved recess for said push block to move along said slit, and a top rib being formed to extend across a top of said curved recess at a predetermined position for engaging with a transverse groove provided at a bottom of said push block so as to hold said push block in place.

3. The film-tape eraser with retractable dispensing head as claimed in claim 2, wherein said dispensing mechanism includes a side cover and a base that are assembled to each other; said base being provided at an inner side near front middle and rear middle portions with two inward projected fixing shafts for a driving tape reel and a driven tape reel, respectively, to mount therearound for winding said erasing film-tape; a guide strip being inward projected from an upper front of said base, and a curved strip being inward projected from a lower rear end of said base; said curved strip having a curved lug extended from an upper outer corner thereof, said crossbar connected to the rear end of said movable strip being abutted against an inner side of said curved lug; and said base being provided at a lower front with a mounting channel for said dispensing head to insert therein.

4. The film-tape eraser with retractable dispensing head as claimed in claim 3, wherein said movable strip is formed at a joint of said crossbar and said movable strip with a through hole, into which said curved lug on said curved strip is inserted.

* * * * *